United States Patent [19]

Joly et al.

[11] Patent Number: 4,746,307

[45] Date of Patent: May 24, 1988

[54] COAXIAL CABLE TRANSMISSION SYSTEM

[75] Inventors: Jean Joly, Houilles; Yves Oehlert, Rueil Malmaison, both of France

[73] Assignee: La Telemecanique Electrique, France

[21] Appl. No.: 38,551

[22] Filed: Apr. 15, 1987

[30] Foreign Application Priority Data

Apr. 17, 1986 [FR] France ..... 86 05507

[51] Int. Cl.[4] ..... H01R 4/24

[52] U.S. Cl. ..... 439/394; 439/582

[58] Field of Search ..... 439/94, 110, 113, 114, 439/121, 207, 208, 211, 394, 578, 582

[56] References Cited

U.S. PATENT DOCUMENTS

| | | | |
|---|---|---|---|
| 2,694,182 | 11/1954 | Edlen et al. | 439/394 |
| 2,694,183 | 11/1954 | Edlen et al. | 439/394 |
| 2,706,282 | 4/1955 | Dudra | 439/394 |
| 2,805,399 | 9/1957 | Leeper | 439/582 |
| 3,543,222 | 11/1970 | Rheinfelder | 439/394 |
| 4,365,859 | 12/1982 | Hutter et al. | 439/578 |
| 4,437,722 | 3/1984 | Bianchi | 439/394 |
| 4,588,249 | 5/1986 | Blichasz et al. | 439/394 |

FOREIGN PATENT DOCUMENTS

| | | | |
|---|---|---|---|
| 0121958 | 10/1984 | European Pat. Off. | 439/582 |

*Primary Examiner*—John McQuade

*Attorney, Agent, or Firm*—William A. Drucker

[57] ABSTRACT

A coaxial cable transmission system is provided in which the coaxial cable is pre-equipped with tapping sleeves fixed to the coaxial cable and spaced apart along its length at a predetermined pitch, each sleeve-tapping box pair including mutual positioning and fixing means, each sleeve provided with at least one closable central well for passing and guiding therethrough a central connecting element associated with the tapping box and intended for making contact with the central conductor of the coaxial cable.

13 Claims, 7 Drawing Sheets

FIG.1A
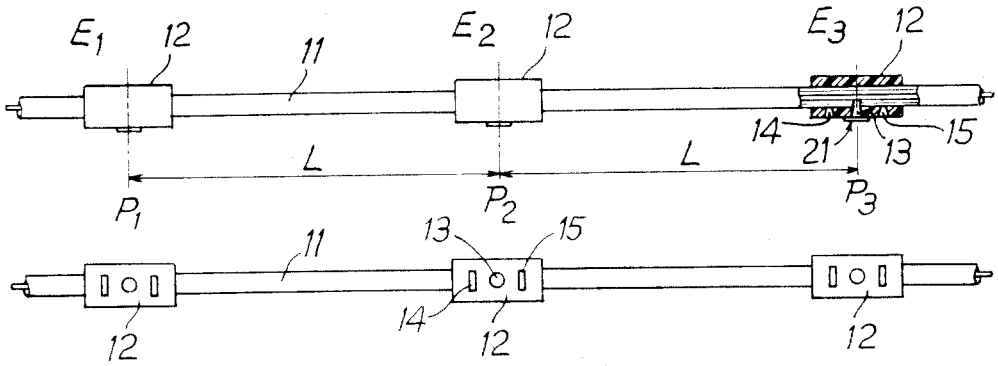
FIG.1B
FIG.2
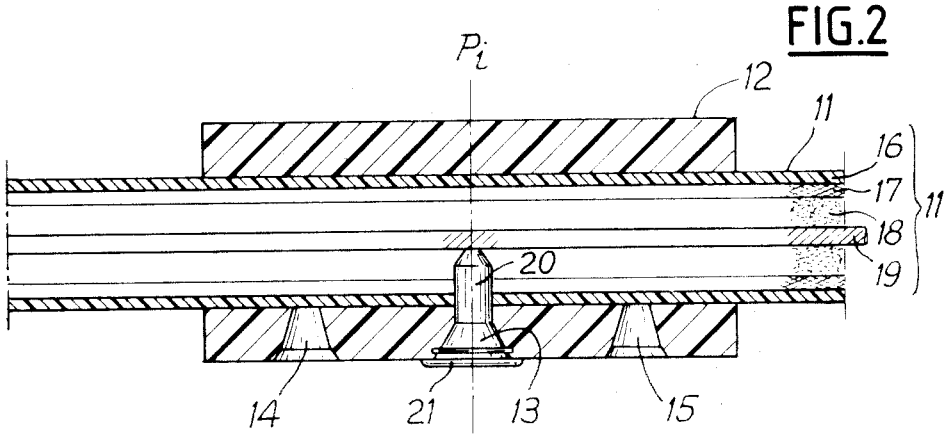
FIG.3
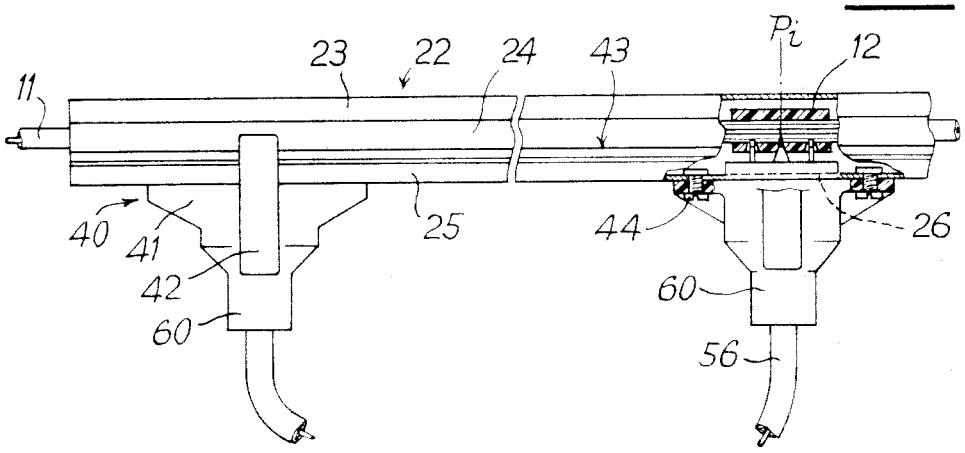

COAXIAL CABLE TRANSMISSION SYSTEM

BACKGROUND OF THE INVENTION

The present invention relates to a coaxial cable transmission system for connecting tapping cables or conductors at pre-established points on a cable.

Coaxial cables include, as is known, a central conductor and an external annular conductor separated by a dielectric and surrounded by an insulating sheath. They are widely used for transmitting low level electric signals used in control, testing, measuring or more generally information transmission installations.

The use of coaxial cables is extending because of the present expansion of cable teletransmission, particularly in buildings and for example in industrial premises.

Numerous devices have been devised for connecting a tapping box with points or teeth for piercing the insulation at any position along the length of the cable. These devices are often complicated and require a considerable force for obtaining a reliable connection more especially with the core of the coaxial cable and have the drawback of leaving an open lesion of the cable so that the tapping cannot be moved for re-use.

In addition, these devices do not allow coaxial cable transmission systems to be constructed for low currents allowing the electric connection of the main coaxial cable with tapping cables at pre-established points.

The purpose of the invention is to overcome this crawback of known devices by means of a coaxial cable transmission system of a relatively low cost price, allowing rapid and reliable connection and disconnection of the tapping cable connectors or terminals at pre-established positions on the main cable.

It also provides for the connection of a tapping cable at pre-established positions on a coaxial cable, guaranteeing satisfactory positioning and maintenance in position of the contacting parts, as well as a minimum lesion of the coaxial cable for facilitating successive disconnections and reconnections at said positions.

It also provides efficient protection of staff against direct contact in the connection zone of the tapping cable on the main cable.

SUMMARY OF THE INVENTION

The invention relates to a transmission system including a coaxial cable and tapping boxes able to be connected and positioned on the cable at tapping positions, the tapping boxes having connection elements adapted for establishing through the insulator an electric connection between the inner conductor and the outer conductor of the main cable and between the corresponding conductors of a tapping cable.

In accordance with the invention, the coaxial cable of the transmission system is pre-equipped with tapping sleeves, these sleeves being fixed to the cable and being spaced apart over its length at a predetermined pitch; each sleeve-tapping box pair includes mutual positioning and fixing means; each sleeve is provided with at least one closable well for the passage therethrough and guidance of a central connection element belonging to the tapping box and intended to be placed in contact with the central conductor of the cable.

The well of the sleeve has possibly a widening shape and serves advantageously for facilitating the prepiercing of the coaxial cable in alignment with said well.

The prefabrication of the coaxial cable with its detachable sleeves, as well as prepiercing at regular intervals along the coaxial cable, facilitates the installation of the system and connection of the tapping cables.

Closure of the well is provided by means of a lid which is broken by the central connection element during contact making and/or by means of a removable plug or cover.

Preferably, the tapping sleeve also includes at least one bell mounted lateral well for facilitating the introduction and guidance of the connection elements with the outer conductor of the coaxial cable.

For supporting the tapping sleeves, either individual supports may be provided, each of which is associated with a sleeve and is fixable to a wall or a duct, or a shaped support formed, for example, by such a duct. When it is made from metal and grounded, the duct may advantageously form an additional means for protecting and screening the coaxial cable.

In an advantageous embodiment, a removable insulating cap surrounds the connection zone of the tapping box, this cap being secured to the box by engagement means which are locked when the box is fixed to the support of the sleeve and are unlockable when the box is removed from the support.

BRIEF DESCRIPTION OF THE DRAWINGS

Other features and advantages of the invention will be clear from reading the following description with reference to the following Figures:

FIGS. 1A and 1B show a coaxial cable equipped in accordance with the invention with tapping sleeves, respectively in elevation and in a bottom view;

FIG. 2 shows on a larger scale an axial section of the cable in the region of a tapping sleeve;

FIG. 3 shows schematically one example of installation of the tapping system;

DESCRIPTION OF THE PREFERRED EMBODIMENTS

Figure 4:
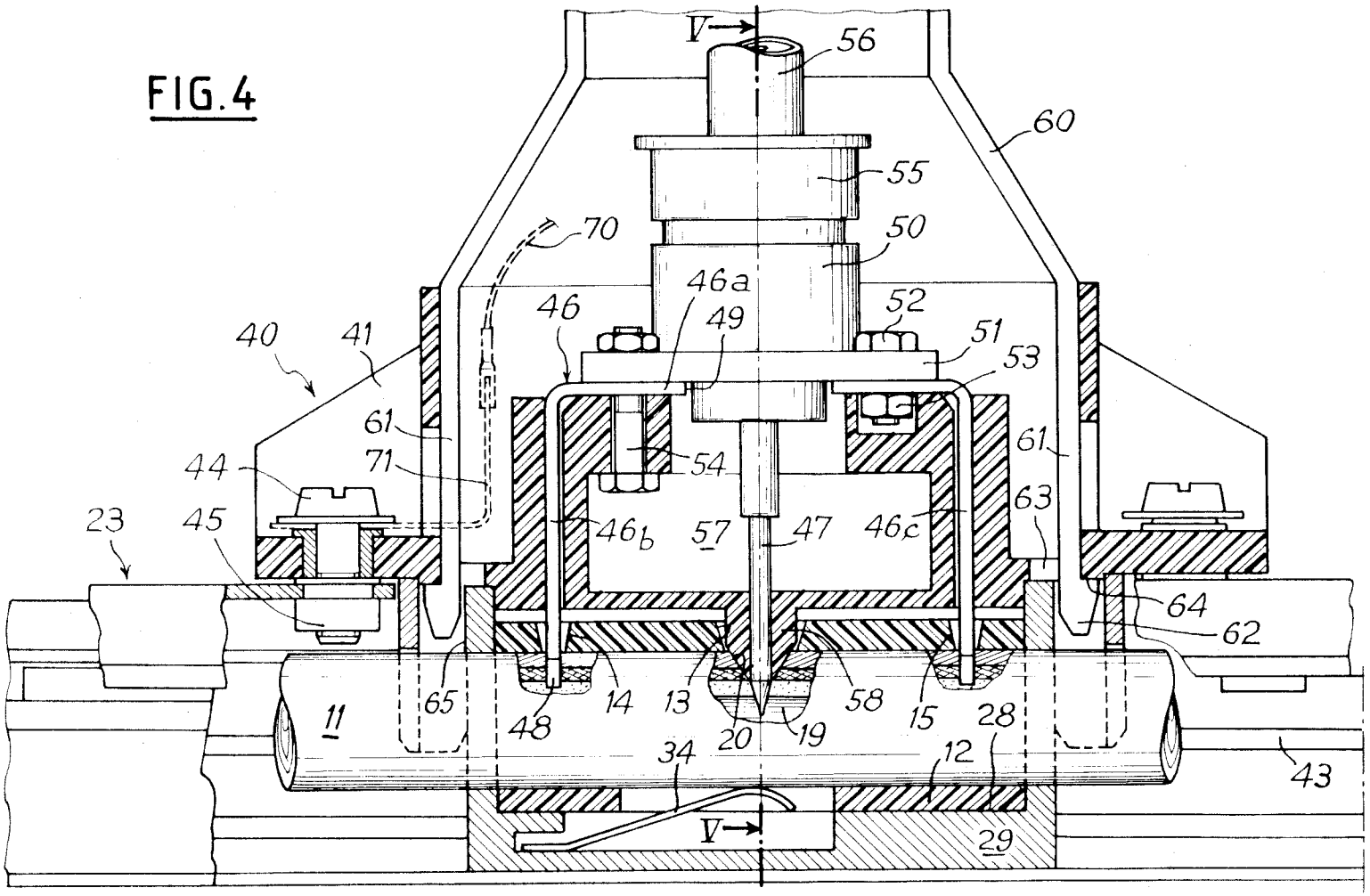
FIG. 4 shows on a larger scale an elevational section of a tapping box fixed to a duct carrying the coaxial cable.
Figure 5:
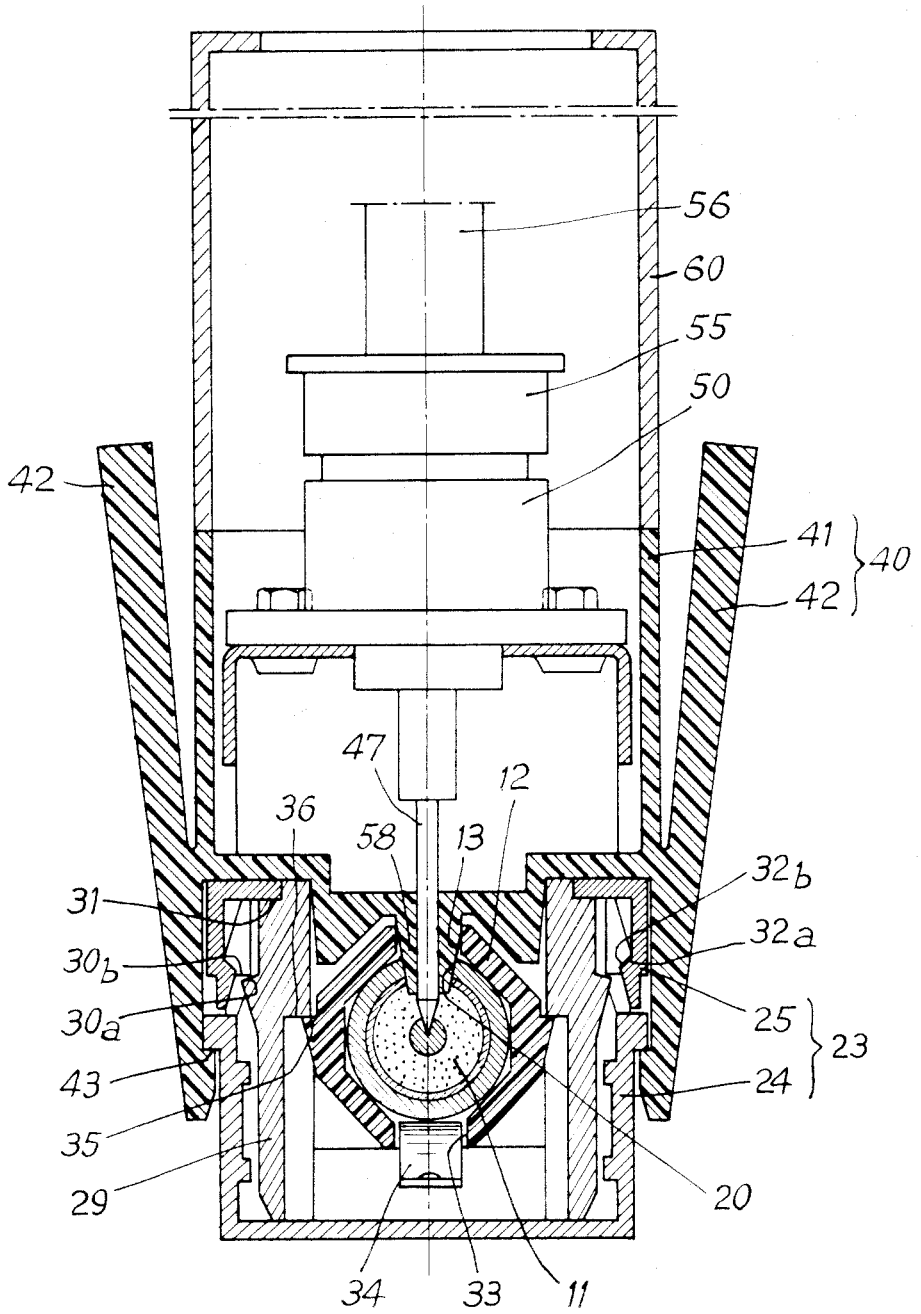
FIG. 5 is the section V—V of FIG. 4.
Figure 6:
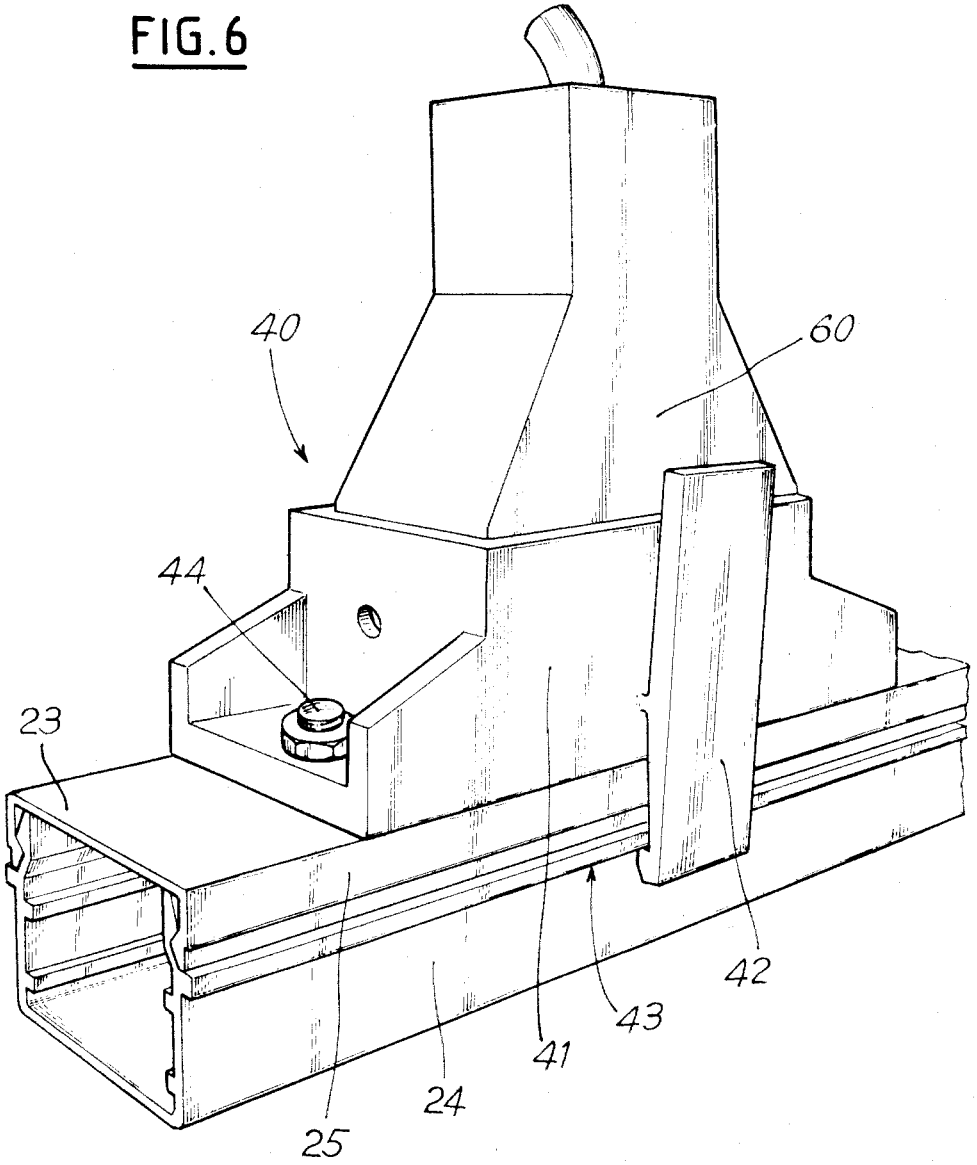
FIG. 6 shows in perspective the box with an insulating cap which protects the tapping.

In the embodiment shown in FIGS. 1 to 7, the transmission system 10 of the invention includes a coaxial cable 11 with fixed tapping sleeves 12 at evenly spaced positions $E_1$, $E_2$, $E_3$ . . . $E_i$, that is to say centered in planes $P_1$, $P_2$, $P_3$,. . . $P_i$ separated from each other by a distance L (FIG. 1A).

Sleeves 12 are separate and are fixed to the coaxial cable by any known method. They are for example overmolded on the cable.

Sleeves 12 have (FIG. 2) a central well of bell mouthed shape 13, preferably in the form of a truncated cone and, on each side of the central well, in the direction of the length of the cable two lateral wells 14, also of a bell mouthed shape. Wells 13 and 14, 15 serve as openings for introducing and guiding tapping box connection elements which will be described further on.

The coaxial cable 11 shown in FIG. 2 includes from the outside of the inside an insulating sheath 16, an outer metal conductor 17, for example in braided form, a dielectric 18 and a central metal conductor 19.

The central well 13 of the sleeve serves advantageously as guide barrel for a drill which provides a prebore 20 of the coaxial cable. Depending on the case, this prebore is stopped before the central conductor 19 or is taken as far as this central conductor. For protecting the connection zone, a removable lid or plug 21 is provided on the central well.

The transmission system may be used as it is with setting of tapping boxes on the sleeves fixed to the cable, the sleeves being either suitably stiffened or fitted or fixed in supports themselves fixed to a mounting wall.

In a preferred embodiment (FIG. 3), the transmission system further includes a duct 22 whose envelope 23 is made from an insulating or conductor material. Envelope 23 is in the present case formed by a U shaped aluminum support section 24 on which is clipped a removable aluminum cover 25 having traps 26 centered in the tapping planes $P_i$ and closable by removable or sliding caps.

Figure 7:
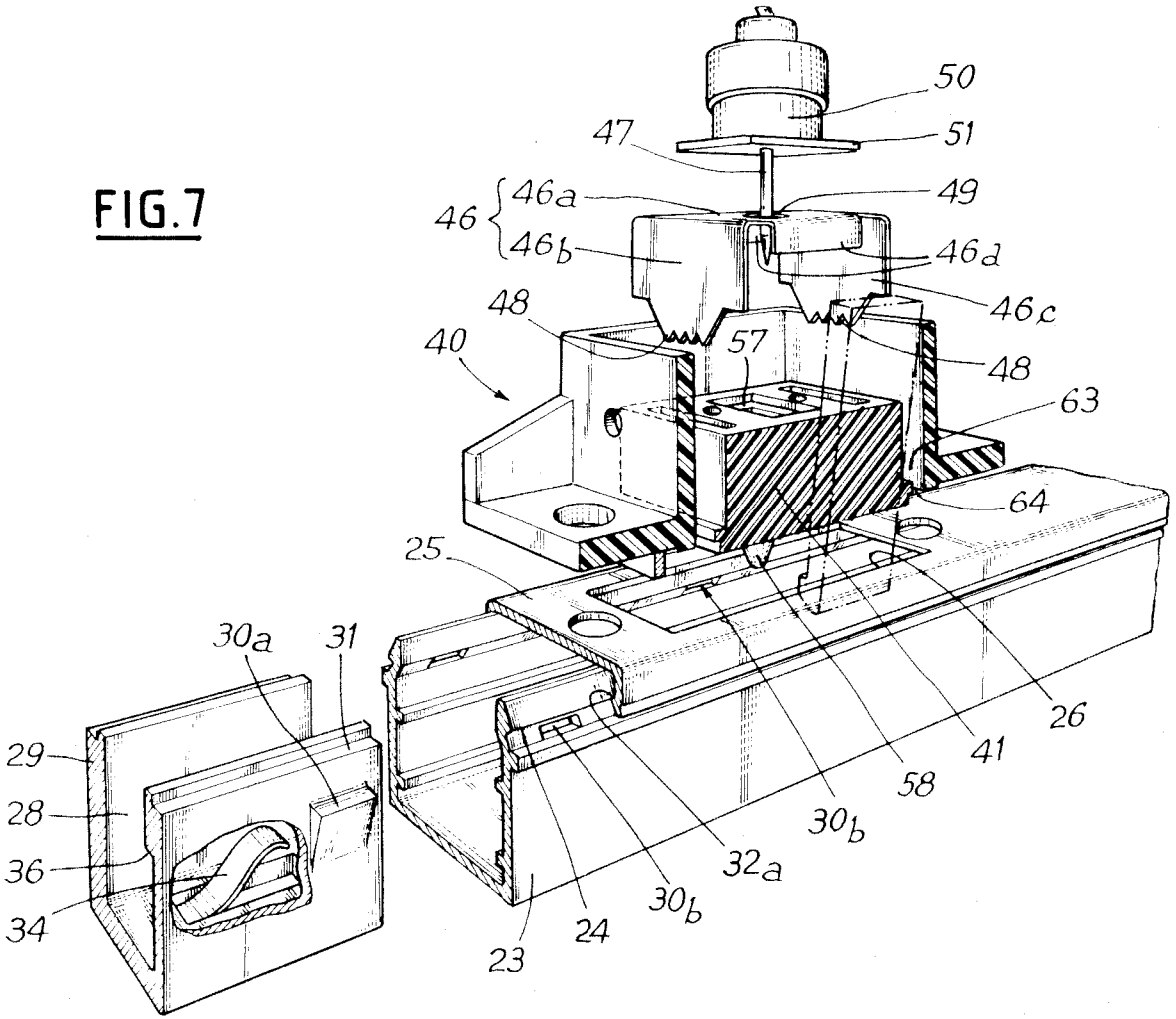
FIG. 7 shows the same perspective without the insulating cap in an exploded view of the tapping device.
Figure 8:
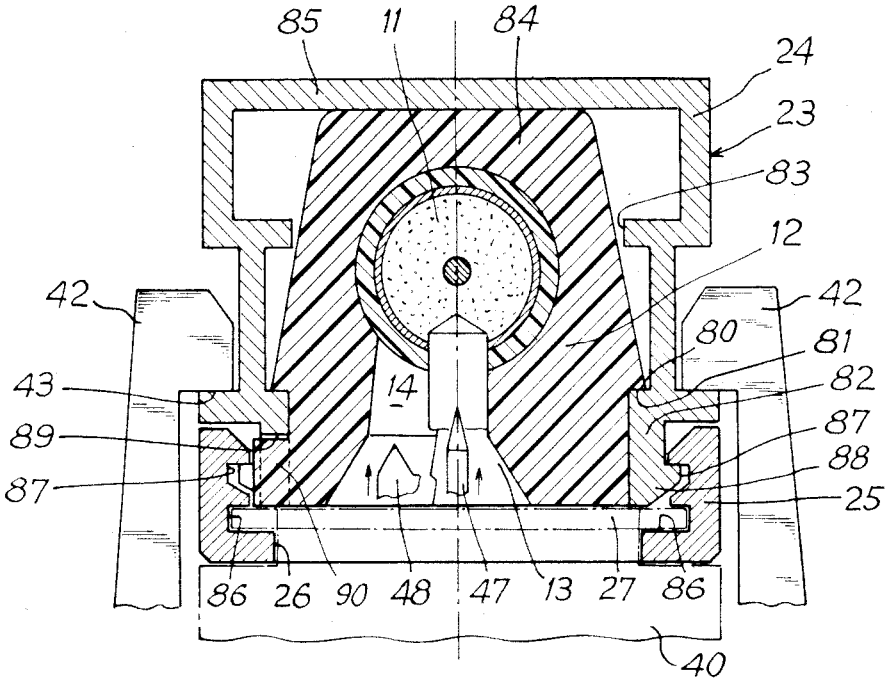
FIG. 8 shows in section a variant of the transmission system of the invention.
Figure 9:
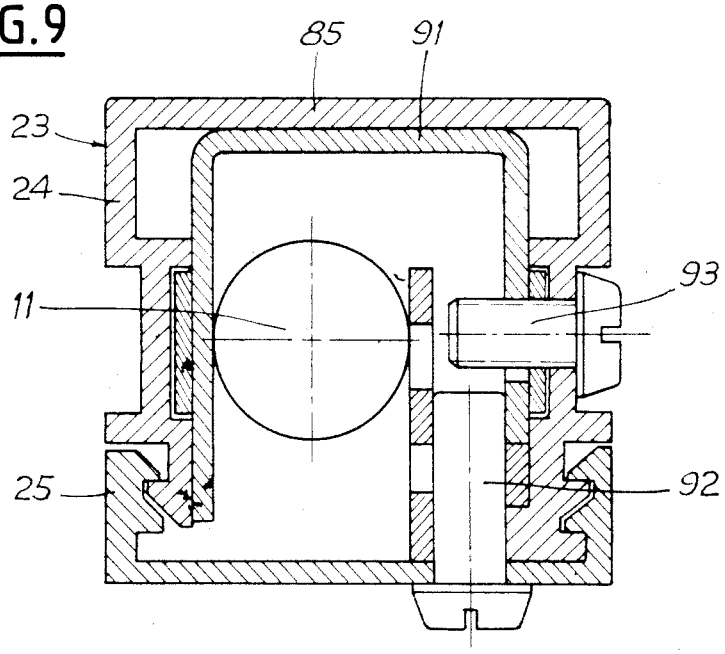
FIG. 9 shows the cross section of the transmission system in a bonding zone of two adjacent duct sections.
Figure 10:
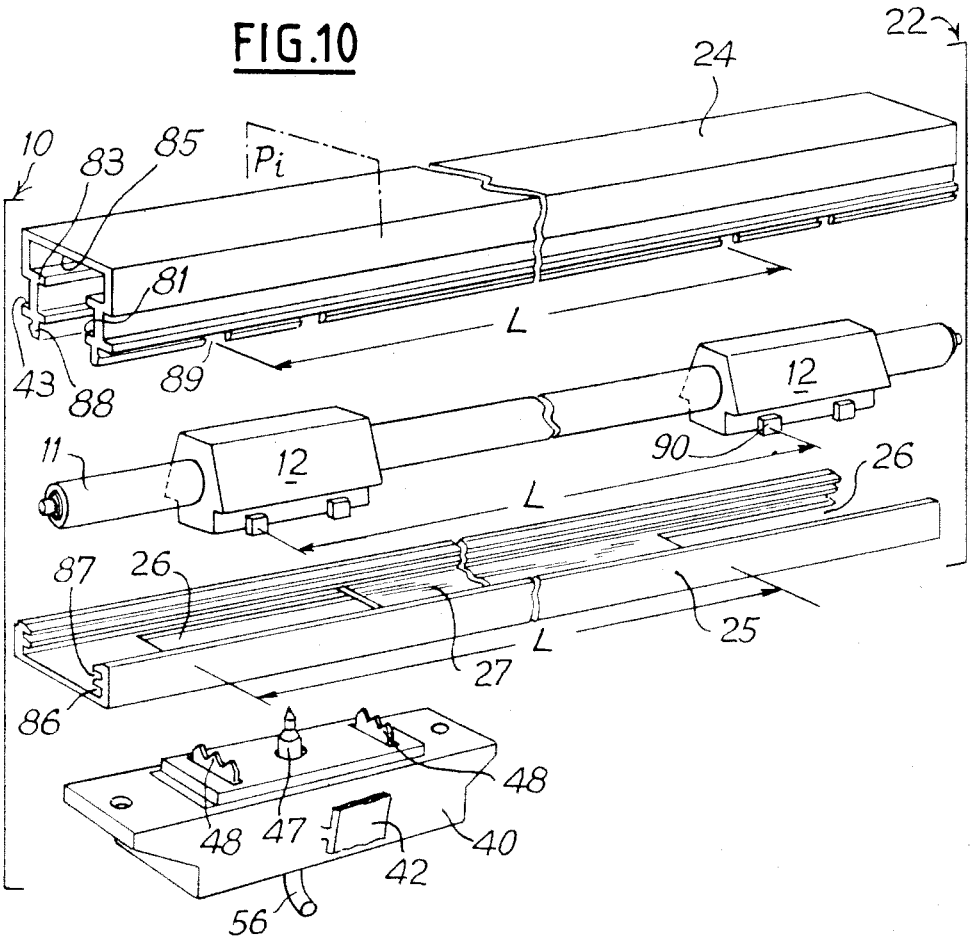
FIG. 10 shows in an exploded perspective view the transmission system of FIG. 8.

Each tapping sleeve 12 is either housed in a recess 28 of complementary shape formed in a support 29 in the form of a cradle itself positioned in the envelope 23 (FIGS. 4 to 7), or is housed directly in the envelope of the duct (FIGS. 8 to 10). It should be noted that in both cases the metal envelope 23 plays the role of double screening for the central conductor 19 of the coaxial cable and may serve as protective conductor by being connected to ground.

In the embodiment shown in FIGS. 4 to 7, each support 29 is held in position in the envelope by means of respective snap fit elements 30*a*, 30*b* (see FIG. 5); this holding in position of supports 29 in the duct is confirmed by the shaped lid 25 coming to bear on a shoulder 31 of the support when the lid is fitted and fixed to the support section 24; the lid is held in position on the support section by respective snap fit elements 32*a*, 32*b*.

The tapping sleeve 12 has a passage 33 for a flexion or compression spring 34 interposed between support 29 or the support section 24 and the coaxial cable 11.

The sleeve is overmolded on the cable, but it could also be formed of two mutual clippable half sleeves. The sleeve is held in position in support 29 by cooperation between respective snap fit elements 35, 36.

The removable tapping box or tap 40 illustrated in FIGS. 3 and 5 to 8 includes an insulating body 41 with two lateral resilient levers 42 for engagement on corresponding ribs 43 of the support section 24 and, simultaneously with the engagement action for providing the desired connection. Engagement of box 40 on the envelope 23 of the duct is completed by fixing the box on the lid 25, for example by means of screws 44 and nuts or tapped holes 45.

A metal connecting piece 46 in the form of a stirrup and a central metal connecting pin 47 are housed in box 40. Piece 46 is intended to pass through the lateral wells 14, 15 of the sleeve and to make contact with the outer conductor 17 of the coaxial cable, whereas pin 47 is intended to pass through the central well 13 of the sleeve and the prebore 20 of the cable and to make contact with the central conductor 19 of the cable. The stirrup 46 has a web 46*a* applied against body 41, two transverse legs 46*b*, 46*c* which pass through passages in the body and are provided at their ends with piercing teeth 48 and two longitudinal facets 46*d* (FIG. 7). The legs and the facets define a screen for the connection zone.

The central pin 47 is disposed substantially in the middle of piece 46 and it forms part of the semi-connector 50 having a flange 51. Flange 51 is fixed by means of bolts 52 to tapped portions 53 of the connecting stirrup 46 so as to provide the electric continuity and is secured with respect to body 41 by means of a bolt-nut assembly 54 (FIG. 4). A semi-connector 55 secured to the coaxial tapping cable 56 is fixed by any usual quick connecting means to the semi-connector 50.

The part of the semi-connector 50 underlying flange 51 and the connecting pin 47 passes through an orifice 49 formed in stirrup 46 and a central housing 57 of body 41. The pin 47 is further held in position close to its lower end by a truncated cone shaped centering protuberance 58 belonging to body 41. This protuberance passes through the central well 13 of sleeve 12 and is centered in the conical mouth of the prebore 20 formed in sleeve 16, the outer conductor 17 and the dielectric 18 of the coaxial cable so as to provide careful centering of pin 47.

An insulating cap 60 (see FIGS. 4 to 7) is associated with the body 41 of the tapping box 40 so as to provide satisfactory protection for users. Cap 60 prevents any direct contact with connector 50, 55 and with the other live parts and it has lugs 61, preferably resilient, whose ends 62 pass with clearance through openings 63 in the body and form hooks engaging on shoulders 64 of body 41. When body 41 is fixed to the envelope 23 of the duct, cap 60 cannot be withdrawn because the hooks 62, locked against walls 65 of the positioning support 29, cannot be disengaged from the shoulders 64.

Removal of the cap requires unscrewing of bolts 44, then raising of body 41 with the connecting pieces 46, 47 which removes the voltage from connector 50, 51, 55 and the conductors of the tapping cable 56. By bending lugs 61, whose hooks 62 may then be removed from the openings 63 in the body, the cap may be removed from the body giving access to the connector.

When the tapping cable includes a screened twisted pair, the two conductors of the twisted pair may be soldered or fixed by any other means, directly or through intermediate elements, to pieces 46, 47; the screening or ground conductor 70 is then fixed for example by means of a fast-on connection to a conducting piece 71 clamped by bolt 44, this being shown with broken lines in FIG. 4. The electric continuity is then established between conductor 70, bolt 44 and lid 25 of envelope 23, the lid itself being grounded.

In the embodiment shown in FIGS. 8 to 10, duct 22 has an envelope 23 with tapping traps 26 closable by sliding covers 27. Envelope 23 includes an aluminum U shaped support section 24 in which is housed the coaxial cable 11 carrying fixed tapping sleeves 12 overmolded at pitch L. Each sleeve 12 is provided with snap fit steps 80 cooperating with shoulders 81 provided on centering ribs 82 inside the envelope 23. Ribs 83 are also provided inside the envelope for limiting the lateral free movement of the sleeve, while allowing a slight expansion of bottom 84 thereof when it is applied on web 85 of the U.

A central outwardly bell mouthed well 13, for example partly in the shape of a truncated cone, is provided in sleeve 12 for guiding and housing the central connecting pin 47 providing the tapping. Lateral wells 14, 15 also with a bell mouthed shape and wider are formed in sleeve 12 on each side of the central well lengthwise of the duct for guiding and housing the teeth 48 of a portion of tapping 40 providing connection with the outer conductor of the coaxial cable 11.

The U shaped section 24 is provided on the outside with ribs having shoulders 43 for receiving snapping hooks or steps 42 of tapping 40.

Cover 25, snap fitted or fixed in another way on the support section, has traps 26 as well as two pairs of grooves 86, 87. Grooves 86 slidingly house the cover 27 of the traps, whereas grooves 87 define shouders cooperating with shaped projections 88 situated at the ends of the legs of the U, 24. In these ends and spaced apart at pitch L are provided apertures 89 in which fit positioning projections 90 provided at the base of the sleeves; other mutual positioning elements could of course be provided in the tapping sleeves and in the envelope.

The mechanical bonding of two adjacent duct sections is illustrated in FIG. 9. A fish-plate 91 bridging between the two sections holds the coaxial cable in position whereas screws 92, 93 provide respectively the electric continuity of the envelope support section 24—fish-plate 91 and support section 24—cover 25.

Figure 11:
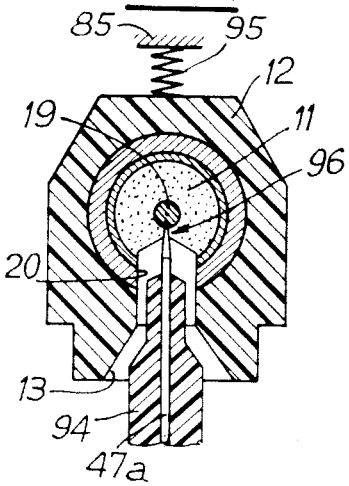
FIGS. 11 to 13 show in section three embodiments of the central connection pin.

In the embodiments described, it is possible to use central connecting pins of different types. In FIG. 11 pin 47*a* and its insulating and guide sheath 94 are engaged in the central well 13 of the sleeve and the prebore 20 of the coaxial cable for making contact with the central conductor 19 of cable 11; the contact pressure is maintained by a spring or other resilient member 95 disposed between sleeve 12 and the web 85 of the support section 24. It will be noted that the prebore 20 of the cable is stopped a little before its central conductor 19 so as to leave a thin wall 96 which forms a cover which is easy to perforate and which ensures the cleanliness of the connection point before the first tapping.

Figure 12:
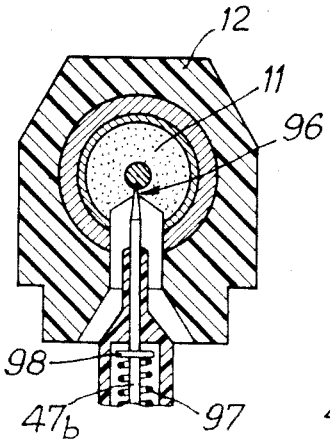

In FIG. 12, the contact is maintained by a spring 97 disposed between a fixed element of tapping 40 and a collar 98 of the connection pin 47*b*. The pin could itself be resilient so as to be compressible lengthwise.

Figure 13:
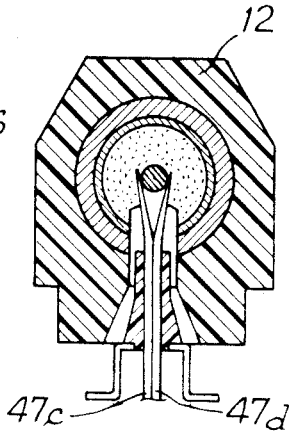

In the variant shown in FIG. 13, two siamese central connecting pins 47*c*, 47*d* may be provided which are resilient and centered in plane $P_i$. These pins are able to bend laterally while enclosing the central conductor 19 of the coaxial cable 11 so as to make a bilateral contact thereon without an additional spring.

The central connecting pin could further have an end in the form of a fork or a V.

The distribution duct described above may advantageously be prefabricated. For this, the tapping sleeves 12 with wells 13, 15 are added at pitch L to the coaxial cable 11, then the cable is prebored at 20 in line with the central wells 13 alone, using their bell shaped form for guiding the drill. The protection of the central conductor 19 is provided either by cover 96, or by a plug 21 or a removable lid.

The connection action follows directly from the action of engaging the tapping box on the duct. In some cases, this connection may however be formed after engagement by screwing or movement towards the axis of the coaxial cable of a part of the box integral with the connecting elements and movable with respect to the rest of the box.

The duct described may finally have a compartment housing power conductors, this compartment being suitably isolated from that which houses the coaxial cable.

We claim:

1. In a transmission system including a coaxial cable having inner and outer conductors and an insulating sheath and tapping boxes positioned at tapping positions along said coaxial cables, said tapping boxes lodging a tapping cable in turn comprising inner and outer conductors and having inner and outer connection elements respectively establishing through the insulating sheath an electric connection between the inner conductor and the outer conductor of the coaxial cable and between the corresponding inner and outer conductors of the tapping cable, the coaxial cable of said transmission system is pre-equipped with tapping sleeves, these sleeves being fixed to the coaxial cable and being spaced apart over its length at a predetermined pitch, the respective tapping sleeves and the respective tapping boxes having mutual positioning and fixing means, each tapping sleeve is provided with at least one closable central well and the inner connecting element passes through said well and cooperates with the tapping box and makes contact with the inner conductor of the coaxial cable.

2. The transmission system as claimed in claim 1, wherein prebores are formed at said predetermined pitch in the coaxial cable in alignment with the central wells of the tapping sleeves.

3. The transmission system as claimed in claim 2, wherein each central well has the shape of a truncated cone.

4. The transmission system as claimed in claim 1, wherein each central well is provided with a removable plug.

5. The transmission system as claimed in claim 2, wherein each said prebore of the coaxial cable is stopped before reaching the inner conductor thereof so as to form a thin protecting cover.

6. The transmission system as claimed in claim 1, wherein each tapping sleeve includes at least one lateral well with a bell mouthed shape for facilitating the introduction and guidance of the elements connecting with the outer conductor of the coaxial cable.

7. The transmission system as claimed in claim 1, further comprising a duct with an envelope in which is housed the coaxial cable pre-equipped with tapping sleeves, said sleeves and said envelope being provided with mutual positioning elements.

8. The transmission system as claimed in claim 1, comprising a duct with an envelope in which is housed the coaxial cable pre-equipped with tapping sleeves, a cradle being held in the envelope at each tapping position for housing the sleeve.

9. The transmission system as claimed in claim 1, comprising a duct with a metal envelope housing the coaxial cable and serving as double grounded screening.

10. The transmission system as claimed in claim 1, wherein each of said tapping box includes a stir-up with transverse legs for screening and connection with the outer conductor of the coaxial cable and longitudinal facets for screening the connection zone.

11. The transmission system as claimed in claim 1, wherein, with each said tapping box is associated an insulating cover immobilized on said box by engagement means which are locked when the box is fixed on an individual support of the tapping sleeve and unlockable when the tapping box is removed from the support.

12. The transmission system as claimed in claim 1, wherein a resilient contact pressure member is provided at each tapping position.

13. The transmission system as claimed in claim 1, wherein each said tapping box is held in position on the individual support of the tapping sleeve by fixing means forming simultaneously a means for clamping a conducting piece on the support, the conducting piece being electrically connected inside the tapping box to a screening of the tapping cable.

* * * * *